US005090091A

United States Patent [19]

Temburg et al.

[11] Patent Number: 5,090,091

[45] Date of Patent: Feb. 25, 1992

[54] BALE OPENING METHOD AND DEVICE HAVING ROLLERS AND GRATE BARS ADJUSTABLE IN HEIGHT RELATIVE TO ONE ANOTHER, FOR DETACHING FIBER TUFTS FROM THE TOP SURFACE OF A BALE

[75] Inventors: Josef Temburg, Jüchen; Ulrich Vollrath, Neuss, both of Fed. Rep. of Germany

[73] Assignee: Trützschler GmbH & Co. KG, Mönchen-Gladbach, Fed. Rep. of Germany

[21] Appl. No.: 387,992

[22] Filed: Aug. 1, 1989

[30] Foreign Application Priority Data

Aug. 2, 1988 [DE] Fed. Rep. of Germany ..... 3826201
Apr. 27, 1989 [DE] Fed. Rep. of Germany ..... 3913929

[51] Int. Cl.[5] ..... D01B 1/14; D01B 1/24; D01B 1/46; D01G 7/04

[52] U.S. Cl. ..... 19/80 R; 19/145.5

[58] Field of Search ..... 19/80 R, 81, 83, 85, 19/86, 87, 90, 91, 93, 97.5, 145.5

[56] References Cited

U.S. PATENT DOCUMENTS

| | | | |
|---|---|---|---|
| 3,135,022 | 6/1964 | Binder | 19/80 R |
| 3,170,196 | 2/1965 | Denis | 19/80 R |
| 3,663,993 | 5/1972 | Roberson | 19/80 R |
| 3,897,018 | 7/1975 | Wilkes et al. | 241/223 |
| 4,536,852 | 8/1985 | Hösel | 19/145.5 X |
| 4,623,099 | 11/1986 | Vosbein et al. | 19/80 R X |
| 4,707,888 | 11/1987 | Binder | 19/80 R |
| 4,748,725 | 6/1988 | Temburg | 19/80 R |
| 4,780,933 | 11/1988 | Pinto | 19/80 R |
| 4,796,335 | 1/1989 | Kranefeld | 19/80 R |
| 4,827,572 | 5/1989 | Walk | 19/80 R |
| 4,928,354 | 5/1990 | Hanselmann | 19/97 |

FOREIGN PATENT DOCUMENTS

| | | |
|---|---|---|
| 2547346 | 4/1976 | Fed. Rep. of Germany . |
| 145165 | 6/1961 | U.S.S.R. . |
| 946333 | 1/1964 | United Kingdom . |

*Primary Examiner*—Werner H. Schroeder
*Assistant Examiner*—Ismael Izaguirre
*Attorney, Agent, or Firm*—Spencer & Frank

[57] ABSTRACT

A travelling fiber tuft detaching device for removing fiber tufts from top surfaces of stationarily supported fiber bales includes two parallel-arranged detaching rollers rotatable about substantially horizontal axes spaced from one another in a travelling direction and extending transversely thereto. Each detaching roller has a plurality of detaching elements arranged in a plurality of side-by-side situated circumferential series. The detaching device further has a grate formed of a plurality of spaced grate bars extending parallel to the travelling direction. The detaching elements of each circumferential series project into spaces between respective adjoining grate bars. There is further provided a roller and/or grate setting device for adjusting a height level of the detaching rollers and/or grates relative to one another for effecting penetration of the detaching rollers into a top bale surface to different depths thereof during detaching operation.

18 Claims, 8 Drawing Sheets

BALE OPENING METHOD AND DEVICE HAVING ROLLERS AND GRATE BARS ADJUSTABLE IN HEIGHT RELATIVE TO ONE ANOTHER, FOR DETACHING FIBER TUFTS FROM THE TOP SURFACE OF A BALE

CROSS REFERENCE TO RELATED APPLICATION

This application claims the priority of Federal Republic of Germany Application Nos. P 38 26 201.0 filed Aug. 2, 1988 and P 39 13 929.8 filed Apr. 27, 1989, which are incorporated herein by reference.

BACKGROUND OF THE INVENTION

This invention relates to an opening device and method for detaching fiber tufts from compressed fiber bales such as cotton or cellulose fiber bales or the like. The opening device has rapidly rotating opening (detaching) rollers which have toothed discs or spikes that cooperate with a grate whose grate bars are situated between the detaching discs or spikes. The opening device travels along the top face of the stationary fiber bales and detaches fiber tufts therefrom.

In a known opening device the parallel axes of the opening rollers are in horizontal alignment with one another. During the forward and return pass the opening rollers penetrate the upper surface of the fiber bale to an equal depth during the detaching operation. The opening rollers rotate in opposite directions such that in the zone of the fiber bales the circumferential part of the opening rollers move towards one another. It is a disadvantage of prior art constructions that as the detaching rollers travel in a given direction during the detaching operation, the two opening rollers detach different quantities of fiber tufts from the fiber bales (one opening roller rotates in the direction of travel and the other rotates oppositely thereto).

SUMMARY OF THE INVENTION

It is an object of the invention to provide an improved opening device of the above-outlined type in which the discussed disadvantages are eliminated and which, in particular, is capable of higher output rate and more uniform detaching operation than prior art constructions.

This object and others to become apparent as the specification progresses, are accomplished by the invention, according to which, briefly stated, setting means are provided for the vertical shift of the opening rollers and/or the grates relative to one another whereby, in the course of the forward and reverse pass during the detaching operation, the opening rollers penetrate to a different depth into the fiber bale surface.

By virtue of the fact that during the detaching operation the opening rollers penetrate to a different extent into the fiber bales, a higher production rate is achieved. Furthermore, the production rate between the detaching roller rotating in the travelling direction and the other detaching roller rotating in the opposite direction is improved, resulting in a significantly more uniform fiber tuft removal operation.

According to an advantageous feature of the invention, the opening rollers are mounted on a switchable rocker. Although Swiss Patent No. 383,841 discloses a bale opener where the two detaching rollers are mounted on a switchable rocker to periodically change the height position of the rollers with respect to one another, the detaching device shown therein is stationarily held with the opening rollers, whereas the heavy fiber bales are moved and the opening rollers engage the fiber bales from below. During forward or reverse travel only a single opening roller engages the fiber bale surface, while the other roller is brought into a position in which it is at a distance from the fiber bale surface and is therefore entirely out of contact therewith.

According to a further feature of the invention, the opening rollers are switchable (that is, simultaneously height-adjustable in an opposite sense) at the end of each forward or reverse (return) pass. This ensures that during any pass the opening rollers are maintained at a constant height. Preferably, during each pass the leading detaching roller penetrates deeper into the fiber bale surface than the trailing detaching roller and the height position of the grates remains constant.

According to another preferred embodiment of the invention, with each opening roller there is associated a separate grate and an adjusting device is provided for a vertical displacement of the grates relative to one another.

According to still another preferred embodiment of the invention, a setting device is provided for the vertical adjustment of the opening rollers and the grates. Expediently, the opening rollers and the grates can be, for adjustment purposes, turned about a common horizontal axis.

In accordance with a further preferred embodiment of the invention, the opening rollers are connected with measuring devices which are, via a comparing device, electrically connected with a control device which applies signals to a setting member for actuating the adjusting device to alter the position of the opening rollers and/or grates. By virtue of measuring the current consumption of the opening rollers it can be determined whether the opening rollers and/or the grates are at the desired height position. In case the measuring values of the two opening rollers are not substantially identical, preferably during the detaching operation the height adjustment is corrected until the measuring values are identical. Expediently, for measuring the current consumption a transducer is used which is associated with a drive motor or motors for the opening rollers. Expediently, a tachogenerator is associated with the opening rollers which senses an rpm variation if the load on the opening rollers changes.

DESCRIPTION OF THE PREFERRED EMBODIMENTS

Figure 1:
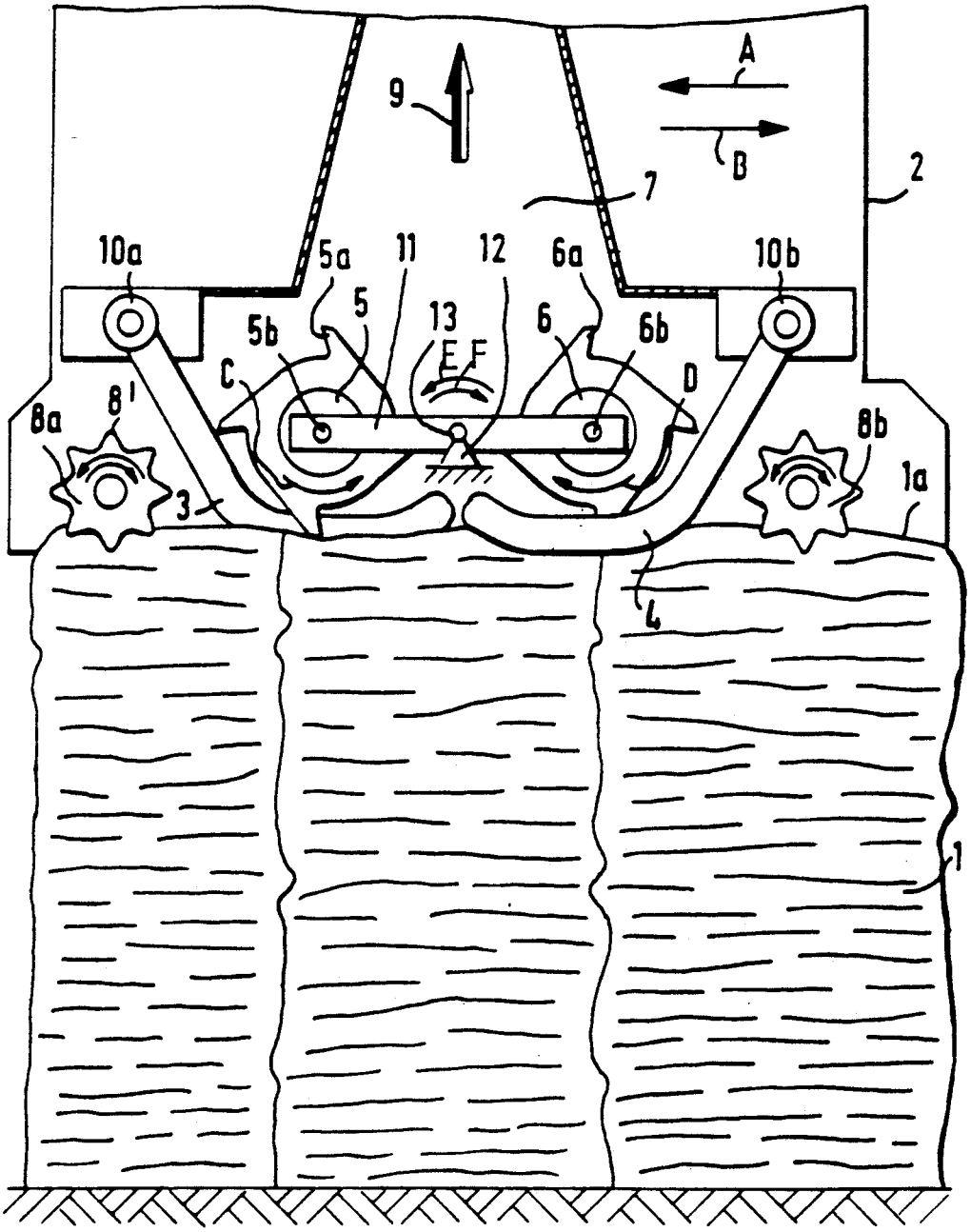
FIG. 1 is a schematic side elevational view of a preferred embodiment of the invention.

Turning to FIG. 1, there is illustrated therein a preferred embodiment of the invention which may be incorporated in a travelling bale opener of the BLENDOMAT BDT model, manufactured by Trützschler GmbH, Mönchengladbach, Federal Republic of Germany. The fiber bales 1 are freely supported on the ground and are arranged in a series along which the bale opener trolley travels back and forth on rails (neither shown). The bale opener has a vertically shiftable detaching device essentially comprising a detacher housing 2, two grates 3 and 4 (each formed of a series of grate bars), two rapidly rotating detaching (opening) rollers 5 and 6 as well as a suction hood for removing, by a vacuum stream, the fiber tufts detached from the upper surface of the fiber bales. The detaching device travels in the direction of B (forward pass) and A (reverse or return pass). The grates 3 and 4 are so arranged that their grate bars extend into the clearances between the axially spaced teeth 5*a*, 5*b* of the disc series of rollers 5 and 6. The grates 3 and 4 engage the top face 1*a* of the fiber bales and thus constitute a hold-down device. Upstream and downstream of the rollers 5 and 6 pressing rollers 8*a* and 8*b* are provided which press down on the surface 1*a* of the fiber bales 1. By virtue of this arrangement and due to the penetration of the teeth of the pressing rollers 8*a* , 8*b* the fiber bales are immobilized and thus are secured against shifting and toppling. In addition, the grates 3 and 4 prevent layers of the fiber bales 1 from being torn out or shifted horizontally by the detaching rollers.

The direction of rotation of the detaching rollers 5 and 6 is in opposite sense as designated with arrows C and D, and is oriented inwardly in the zone of the upper face 1*a* of the fiber bales 1. Stated differently, in the detaching zone (that is, where the rollers 5 and 6 engage the bale faces 1*a*) the rollers 5 and 6 rotate towards one another. The suction hood 7 is situated above the detaching rollers 5, 6. In operation, the detaching device, together with the detaching rollers 5 and 6 travels back and forth above the freely standing fiber bales 1 while the teeth 5*a*, 6*a* of the respective detaching rollers 5 and 6 extend through the grate gaps defined by the grate bars and penetrates into the fiber bale surface. The fiber tufts torn out from the upper face 1*a* of the fiber bales 1 are thrown inwardly by the detaching rollers 5 and 6. The fiber tufts are immediately introduced into the vacuum stream 9 guided through the suction hood 7 and are removed by the air stream through a suction channel for further processing.

The grates 3 and 4 are each formed of a plurality of grate bars. Each grate bar has three zones: a first end, a mid zone and a second end. The respective first ends project away from the upper bale face 1*a* under a predetermined angle whereas the mid zones are in engagement with the bale face 1*a* in a substantially horizontal orientation. The second ends are arranged at an oblique angle to the upper bale face 1*a*. The first ends together define an open, free end of the respective grate, whereas the second ends are secured to holder elements 10*a*, 10*b*, respectively. Each detaching roller 5 and 6 is associated with a separate grate 3, 4; the open ends of the grates 3 and 4 are oriented towards one another.

The detaching rollers 5 and 6 are mounted on a rocker 11 which has a central transverse horizontal shaft 13 held in a pivotal support 12 for swinging motion as indicated by arrows E and F and which may be moved (switched) to assume different positions by means of a power device and control arrangement as described in connection with FIG. 5. The shafts 5*b* and 6*b* of the respective detaching rollers 5 and 6 are mounted on opposite ends of the rocker 11. In FIG. 1, the rocker 11 is shown in a horizontal, transitory position.

Figure 2A:
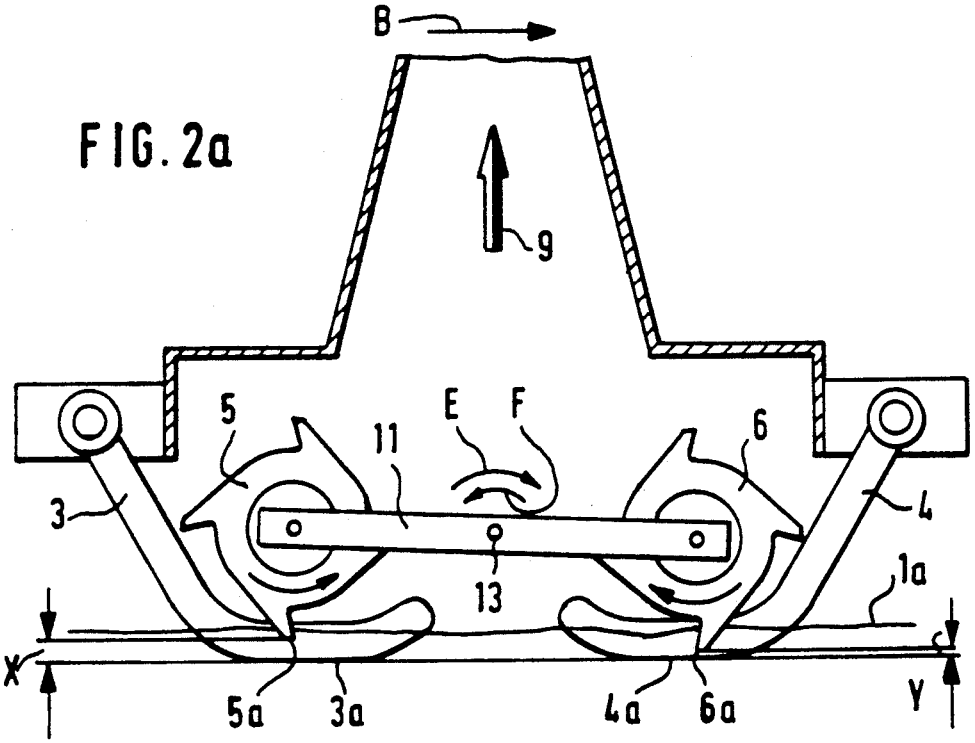
FIGS. 2*a* and 2*b* are schematic side elevational views of the preferred embodiment depicted during forward and reverse travel, respectively.

Turning to FIG. 2*a*, the opening device is depicted during its forward pass (travel in the direction of arrow B). The rocker 11 slopes downwardly in the direction of travel and thus the leading detaching roller 6 penetrates deeper into the bale surface 1*a* than the trailing detaching roller 5. Both detaching rollers 5 and 6 simultaneously engage the fiber bale during the forward pass. Thus, in the lowermost position the tooth tips 6*a* of the detaching roller 6 are at a smaller distance y from the lowermost face of the mid zone 4*a* of the grate 4 than the distance x of the tooth tips 5*a* from the lowermost face 3*a* of the grate 3.

Figure 2B:
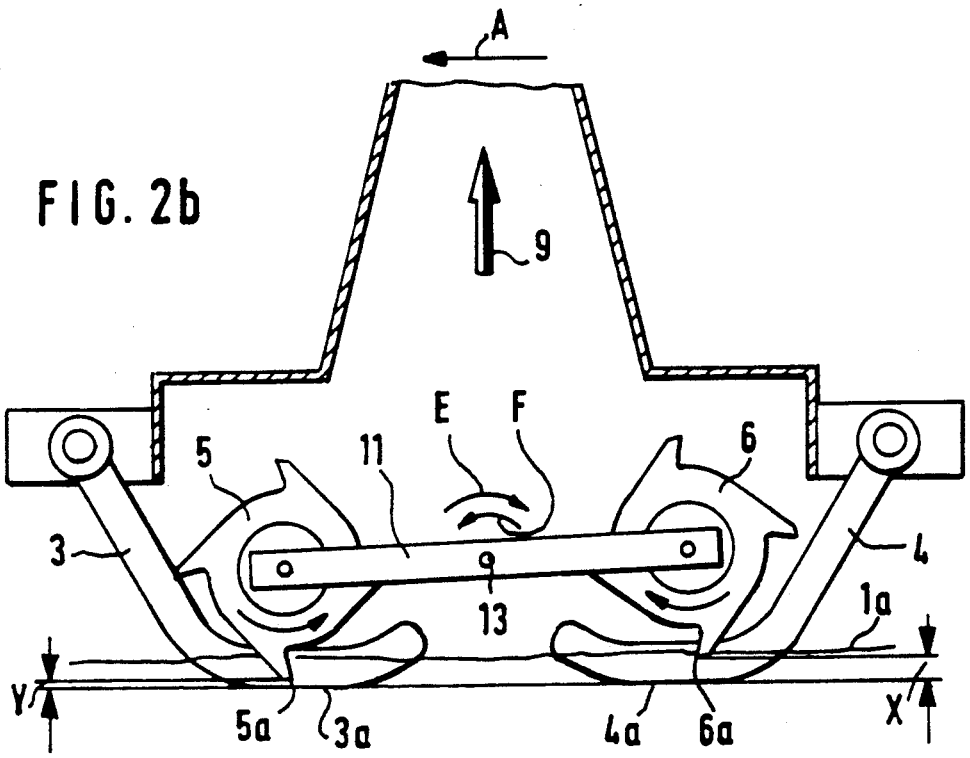

FIG. 2*b* shows the opening device during its reverse travel (return pass) in the direction of the arrow A. The rocker 11 has changed its pivotal position and slopes downwardly in the direction of reverse travel, whereby the leading detaching roller 5 penetrates deeper into the fiber face 1*a* than the trailing detaching roller 6. Accordingly, the magnitude of the distances x and y have changed position: the tips 5*a* of the now-leading roller 5 from the lowermost face of the mid portion 3*a* of the grate 3 is smaller than the distance x of the tooth tips 6*a* from the lowermost face 4*a* of the mid portion of the grate 4. The switching of the rocker 11 is effected at the end of each pass; the grates 3 and 4 remain at the same height, that is, the underface of the mid portion 3*a* of the grate 3 is substantially coplanar with the underface of the mid portion 4*a* of the grate 4.

Figure 3A:
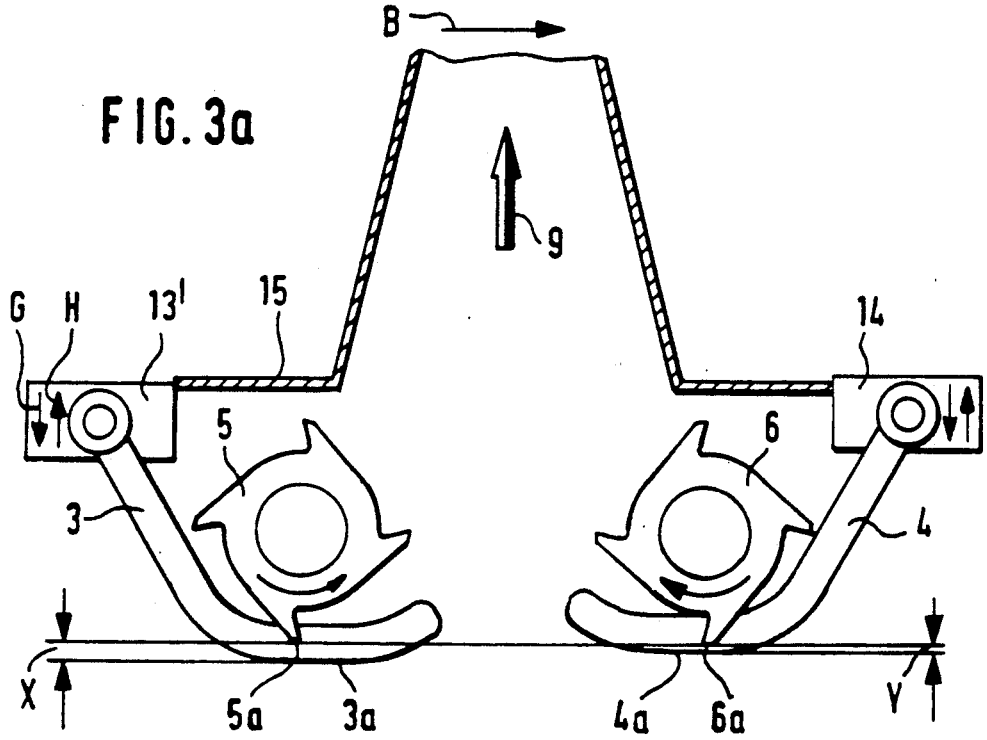
FIGS. 3*a* and 3*b* are schematic side elevational views of another preferred embodiment of the inventor, depicted during forward and reverse travel, respectively.
Figure 3B:
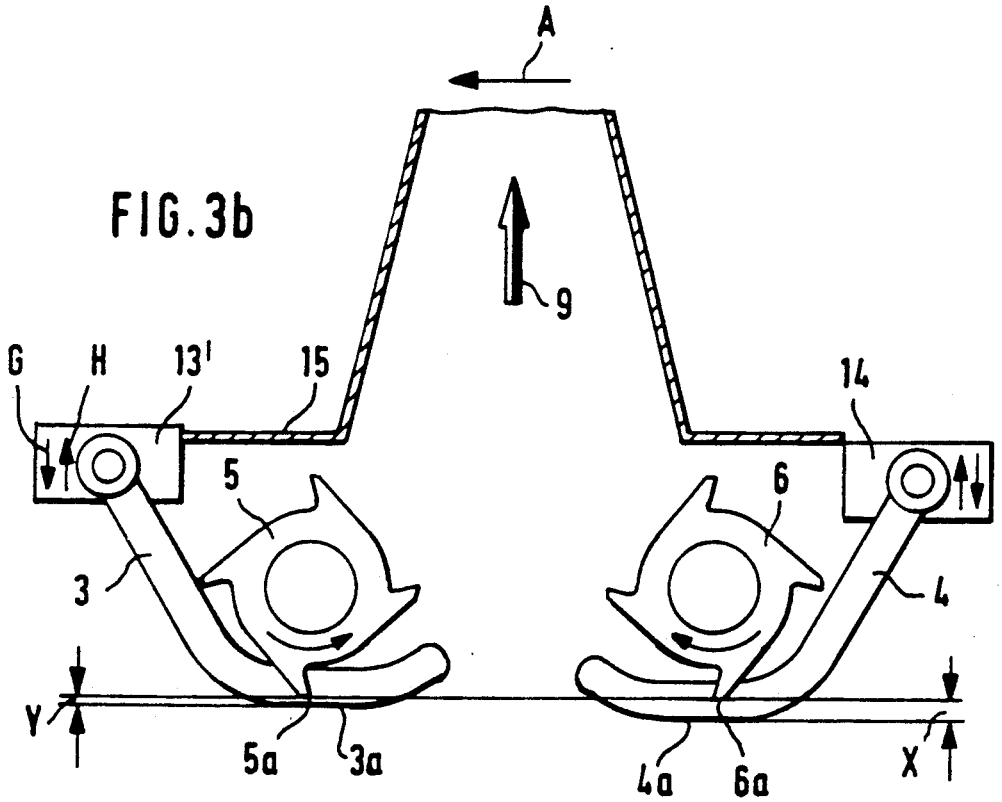

Turning now to the embodiment illustrated in FIGS. 3*a* and 3*b*, the grates 4 and 5 are vertically adjustable by means of grate holding devices 13 and 14, respectively, relative to the housing 15 and relative to one another as indicated by arrows G and H. this embodiment the detaching rollers 5 and 6 remain at the same height relative to the housing and to one another. Thus, it may be observed by comparing FIG. 3*a* which illustrates the detaching device during its forward pass in the direction of arrow B with FIG. 3*b* which shows the detaching device during its reverse pass in the direction of arrow A, that in each instance the tooth points of the leading roller are at a smaller distance y from the underface of the mid zone of the associated grate than the distance x of the tooth points of the respective trailing roller. As in the previously described embodiment, the detaching rollers 5, 6 engage the fiber bales simultaneously and the holding devices 13 and 14 are simultaneously adjusted at the end of each pass to effect the height adjustment of the grates 3 and 4.

Figure 4A:
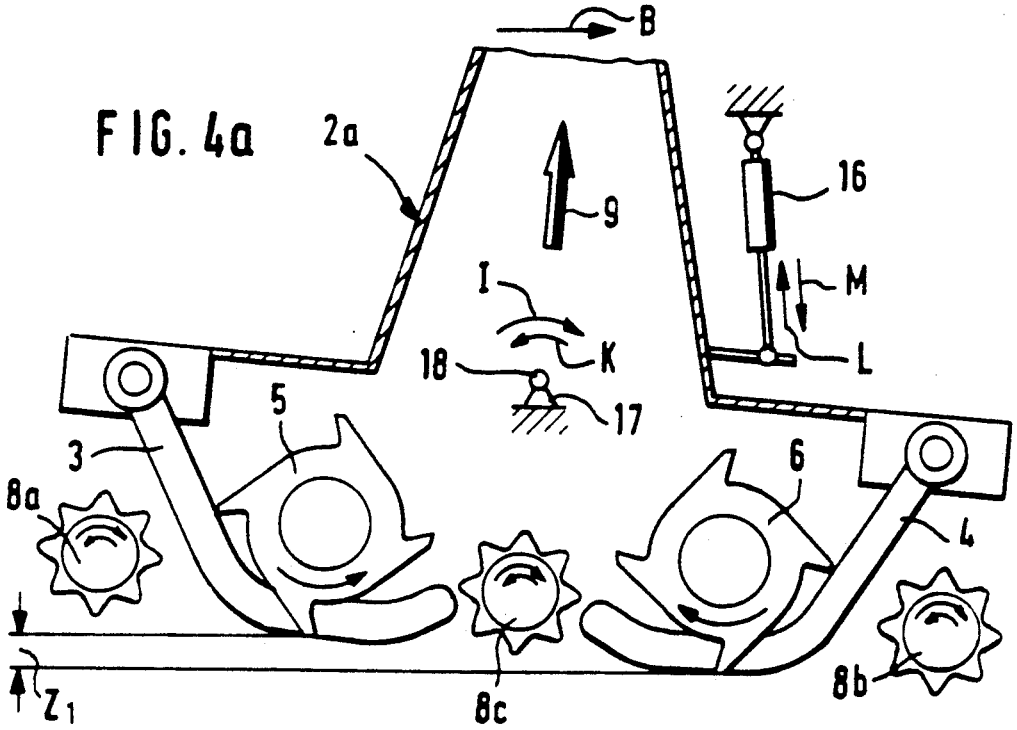
FIGS. 4*a* and 4*b* are schematic side elevational views of yet another preferred embodiment of the invention, shown during forward and reverse travel, respectively.
Figure 4B:
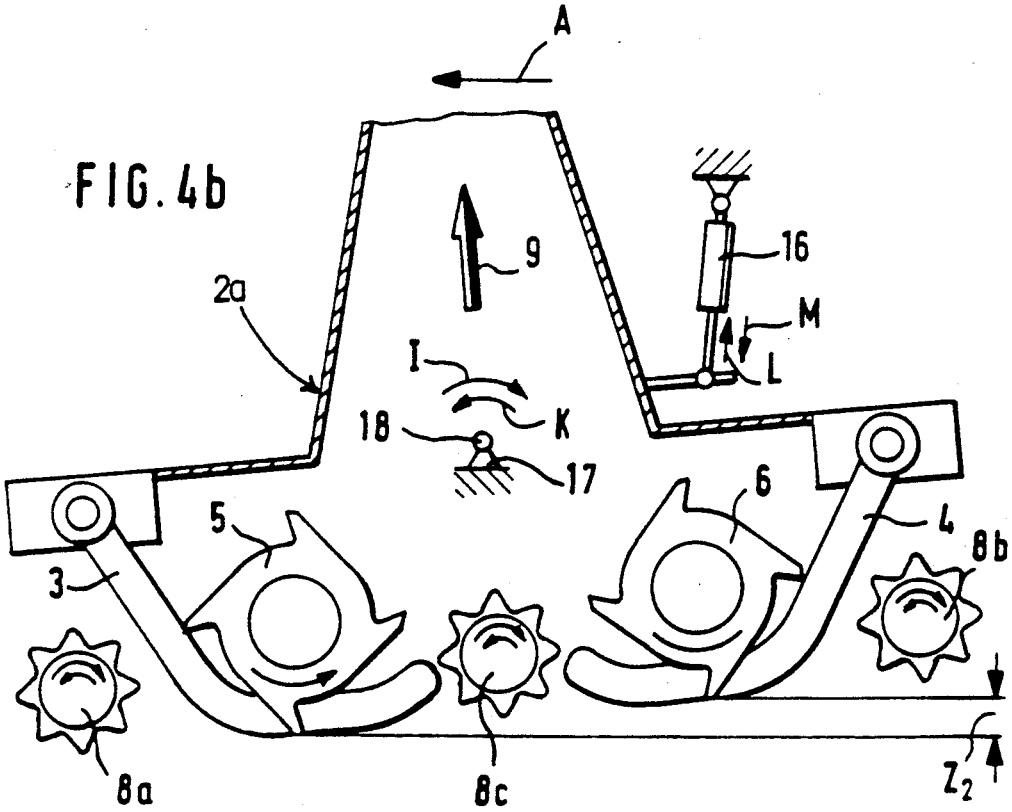

Turning now to the embodiment illustrated in FIGS. 4*a* and 4*b*, there is provided a pneumatic power cylinder 16 which is connected to the detacher housing generally designated at 2*a* for effecting a rocking height adjustment of the detaching device as a whole. The detacher housing 2a has a pivot shaft 18 which is held in a pivotal support 17 and about which the entire detaching device is pivotal in the direction designated by arrows I and K. In this manner, the detaching rollers 5, 6 as well as the grates 3, 4 and the pressing rollers 8a, 8b, 8c also move in a vertical plane about the axis of the shaft 18, whereby a vertical adjustment of the detaching rollers, the grates and the pressing rollers is achieved. FIG. 4a shows the detacher housing 2a in a slightly clockwise tilted position (relative to the vertical) so that for the forward pass in the direction of arrow B the trailing detaching roller 5 and the associated grate 3 are by a vertical distance $z_1$ higher than the leading detaching roller 6 and its associated grate 4. In FIG. 4b, on the other hand, the detacher housing 2a is shown in its slightly counterclockwise tilted position where, for the reverse pass (arrow A) the trailing detaching roller 6 and its associated grate 4 are at a vertical distance $z_2$ higher than the leading detaching roller 5 and its associated grate 3.

Figure 5:
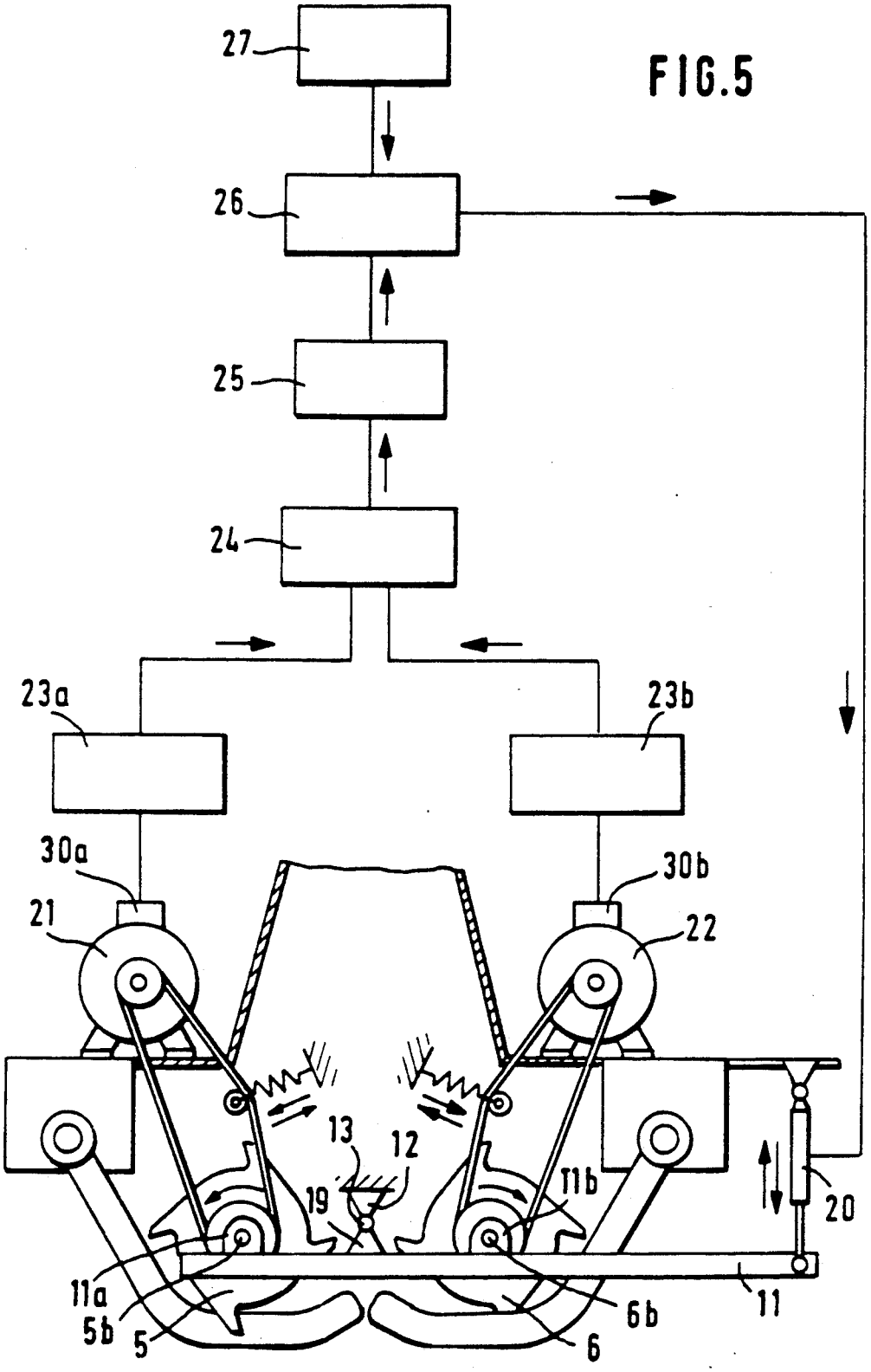
FIG. 5 is a schematic side elevational view of still another preferred embodiment of the invention illustrated with block diagram for an automatic height control.

Turning to the embodiment illustrated in FIG. 5, the opening rollers 5 and 6 are mounted on the rocker 11 which is mounted on a pivotal support 12 to be swingable about a shaft 13 attached to the rocker 11 by a bracket 19. The shafts 5b and 6b of the opening rollers 5 and 6 are held in rocker bearings 11a and 11b, respectively. A pneumatic power cylinder 20 is connected to one end of the rocker 11 for causing pivotal motions (height adjustments) thereof about the shaft 13.

The opening rollers 5 and 6 which are driven by motors 1 and 22 with the intermediary of sprockets and sprocket chains are electrically connected with respective measuring devices 23a, 23b for measuring the current consumption of the motors. In case the teeth 5a, 6a of the opening rollers 5 and 6 penetrate deeper into the bales 1, that is, one opening roller removes fiber tufts at a greater rate than the other, the current consumption is greater for the former than for the latter opening roller. The measuring devices 23a, 23b are connected with a comparator 24 for comparing the measured current consumption of the motors 21 and 22. The comparator 24 is connected, via an amplifier 25, with a control device 26, such as a microcomputer with microprocessor. The control device 26 is, in turn, connected with the central control device 27 for the bale opener. The control 27 transmits signals commanding the appropriate travelling direction (forward or reverse run) of the detaching device. An output of the control device 26 is connected to an input of the pneumatic power cylinder 20. In case of an unlike current consumption by the drive motors 21 and 22, the pneumatic cylinder 20 is automatically set such that the difference between the current consumptions is reduced to zero. For this purpose, the regulating circuit 26 receives data concerning the travelling direction of the detaching device in order to appropriately control the height adjusting device for the pneumatic cylinder 20. For example, it is determined which of the opening rollers 5 and 6 rotates in a direction opposite the travelling direction; thereafter the trailing opening roller is partially withdrawn from the bale surface 1a while, at the same time, the leading opening roller is dipped deeper into the bale surface 1a. Electric terminal boxes for the motors 21 and 22 are designated at 30a and 30b, respectively. It will be understood that the control system described in conjunction with FIG. 5 can be utilized to adjust the relative height level of the grates 3 and 4 (FIGS. 3a, 3b) or the extent of tilt of the described rocker structures (FIGS. 2a, 2b, 4a, 4b, 7a, 7b).

Figure 6:
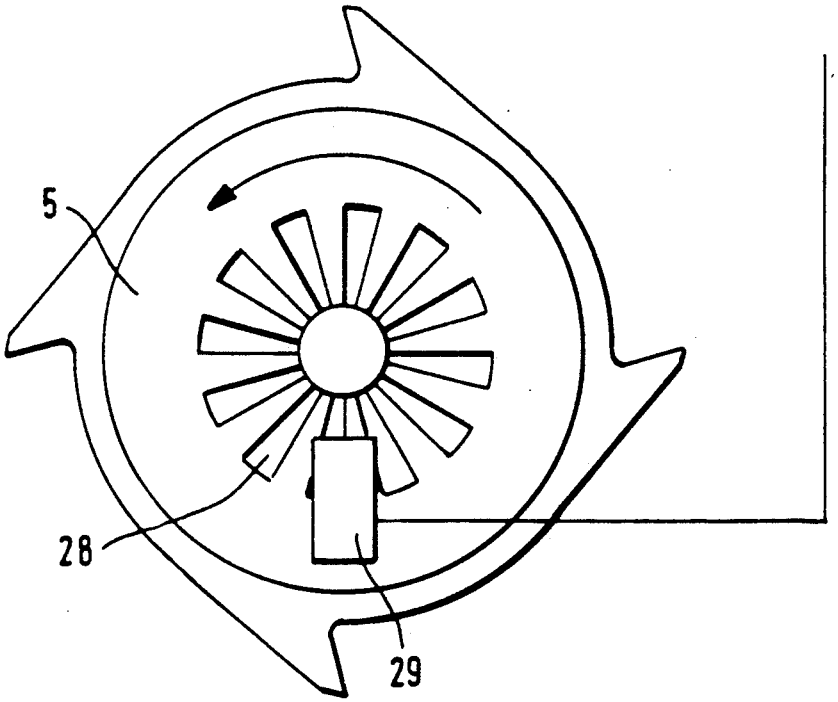
FIG. 6 is a schematic side elevational view of a component of the embodiment illustrated in FIG. 5.

Turning to FIG. 6, there is illustrated the opening roller 5 with which there is associated an incremental rotation indicator formed of a slotted disc 28 and a stationary sensor 29. The slotted disc 28 is affixed to a radial face of the opening roller 5. A similar sensor is associated with the opening roller 6. The two sensors associated with the opening rollers 5 and 6 are connected with the comparator 24 and the control device 26 illustrated in FIG. 5.

Apart from measuring the current consumption, the power input may be determined by measuring the phase shift, the power output or the torques of the drive motors 21, 22.

Figure 7A:
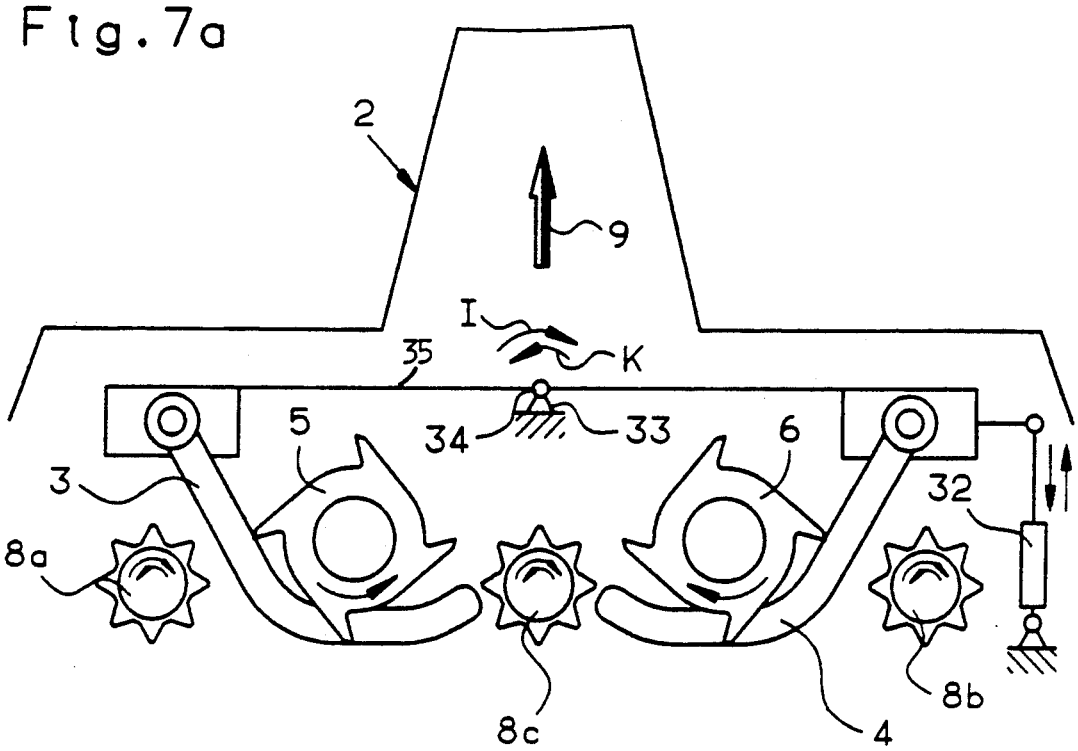
FIGS. 7*a* and 7*b* are schematic side elevational views of a further preferred embodiment of the invention, shown in an intermediate position and during reverse travel, respectively.
Figure 7B:
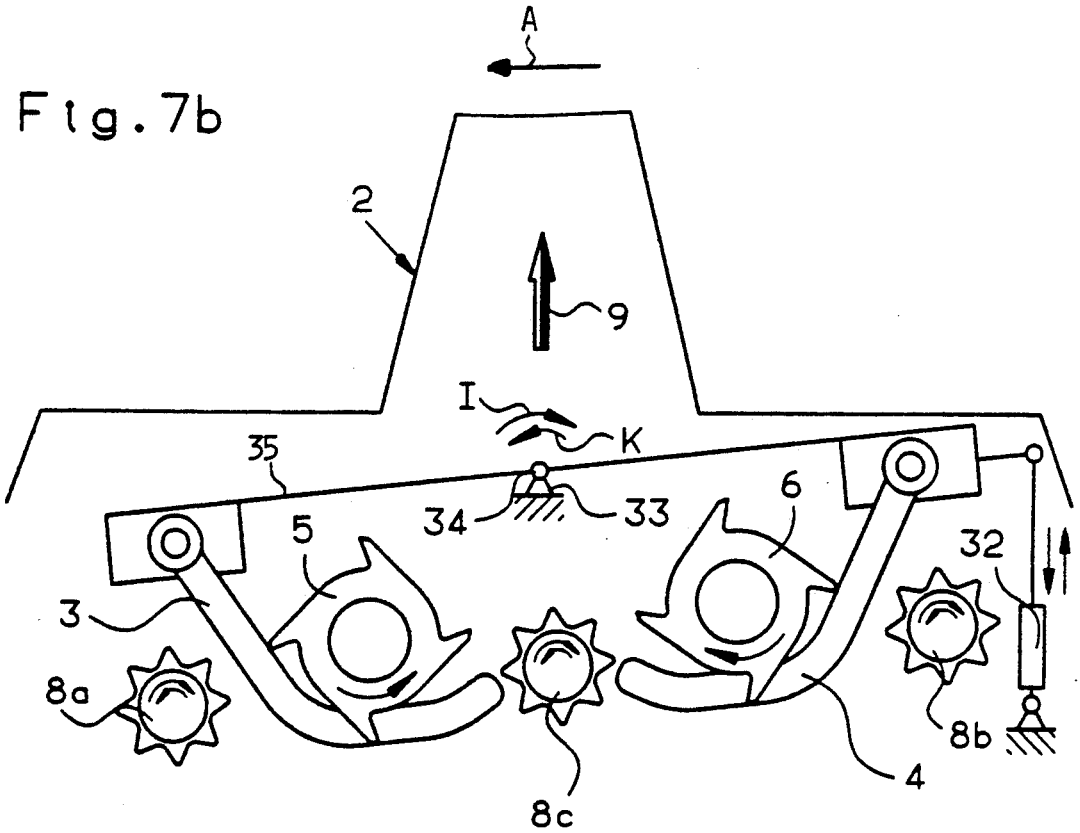

Turning to FIGS. 7a and 7b, according to a further preferred embodiment of the invention, within the non-rockable housing 2 of the detaching device of the fiber bale opener a frame 35 is rockably supported by a pivot 33, 34 which, in turn, is supported by the housing 2. The housing 2 is, in a known manner not illustrated, cantilevered to the travelling tower of the bale opener, and can execute downward feed motions during the fiber tuft detaching operation. The grate bars 3, 4, the detaching rollers 5, 6 as well as the pressing rollers 8a, 8b and 8c are mounted in the frame 35 and are thus rockable therewith as a unit. The setting device 32 is a power cylinder which is articulated to the frame 35 and thus effects its rocking motion about the bearing 33, 34 as indicated by the arrows I, K. Thus, as shown in FIG. 7b, such a rocking motion of the frame 35 effects a height alteration of the detaching rollers 5, 6 and the pressing rollers 8a, 8b, 8c independently from the housing 2, as a departure from the embodiment illustrated in FIGS. 4a, 4b.

By virtue of the vertical shift of the detaching rollers 5 and 6 the angle of the working plane of the detaching device operating on a series of fiber bales may be altered in a simple manner. In particular, at the beginning of the detaching operation, from a horizontally positioned bale face one may achieve, by a progressive height adjustment of the detaching roller, an oblique bale face which may be maintained during further tuft removing operation. In this detaching method, fiber bales are continuously resupplied to that side of the bale series which is opposite the oblique surface. At the end of the detaching operation, the detaching rollers are progressively (stepwise) turned in the opposite direction so that the oblique surface once again assumes a horizontal orientation. By virtue of the fact that the cantilevered housing 2 is supported on the bale opener tower independently from the detaching device, rotary gears and the like for the housing 2 are not needed whereby structural simplification is achieved. It suffices to maintain the housing 2 in a constant manner either in a horizontal or in a predetermined oblique position and only the detaching device is turned (rocked). The vertical downward feed of the housing 2 and the travel motion of the tower as a function of the predetermined oblique angle are effected by means of a control device in a known manner.

For the displacement of the detaching rollers 5, 6 there is expediently provided on the bale opener tower a ring gear with inner teeth to mesh with a toothed gear connected with the detacher housing 2 or with the setting device 32.

Figure 8A:
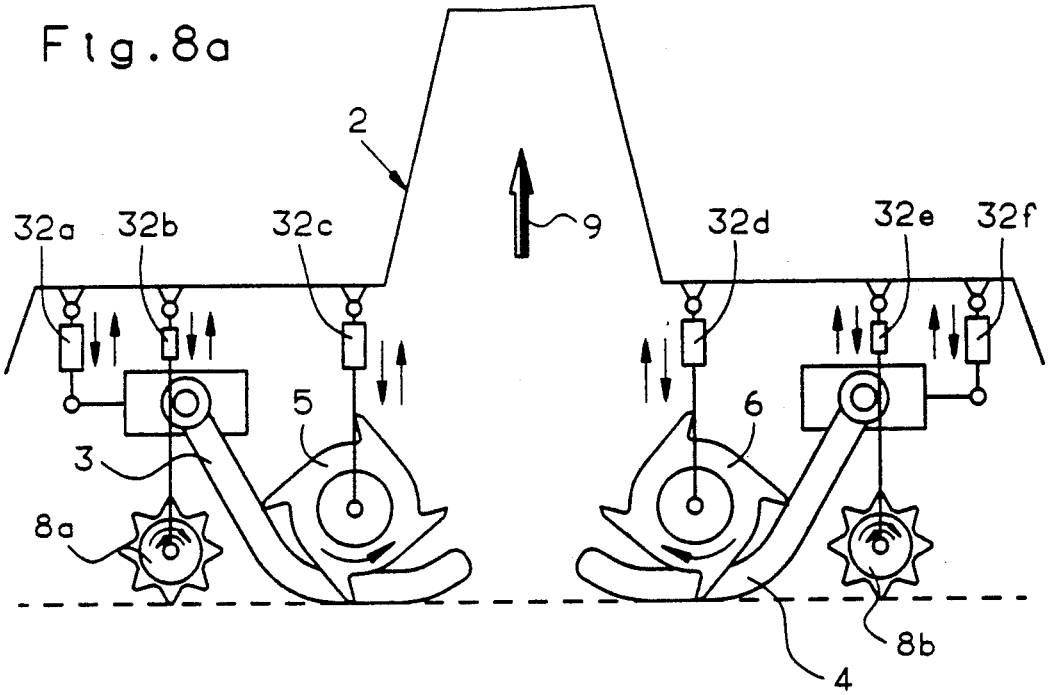
FIGS. 8*a* and 8*b* are schematic side elevational views of still another preferred embodiment of the invention, shown in a position for horizontal and inclined detaching, respectively.
Figure 8B:
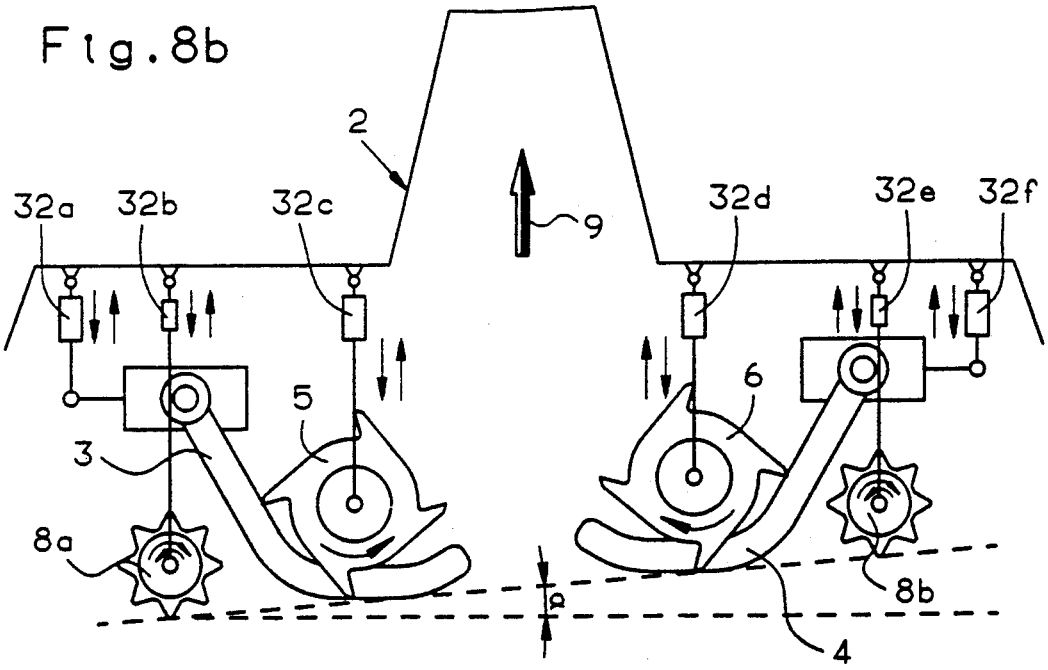

Turning now to FIGS. 8a and 8b, the embodiment illustrated therein is particularly adapted for providing a working (detaching) plane on the top of the fiber bales which is inclined to the horizontal. The detaching rollers 5, 6, the grates 3, 4 and the pressing rollers 8*a*, 8*b* are each associated with separate setting devices (pneumatic cylinders) 32*a*–32*f*. The piston rods of the pneumatic cylinders 32*a*–32*f* are movable as indicated by the double-headed arrows. This arrangement provides for an individual vertical displacement of the detaching rollers 5, 6, the grates 3, 4 and the pressing rollers 8*a*, 8*b*. The non-illustrated control device associated with the pneumatic cylinders 32*a*–32*f* provides for a predetermined, gradual relative vertical shift between the components during the detaching pass such that the desired working plane inclination (angle $\alpha$) is achieved. The housing 2 of the detaching device, together with the detaching rollers, grates and pressing rollers is, as a unit, vertically movably mounted on the tower of the bale opener. The relative vertical shift—effected by the setting devices 32*a*–32*f*—between the detaching rollers 5 and 6, between the grates 3 and 4 and between the pressing rollers 8*a* and 8*b* is thus effected relative to and independently from the housing 2 of the detaching device.

It will be understood that the above description of the present invention is susceptible to various modifications, changes and adaptations, and the same are intended to be comprehended within the meaning and range of equivalents of the appended claims.

What is claimed is:

1. In a travelling fiber tuft detaching device for removing fiber tufts from top surfaces of stationarily support fiber bales, including two parallel-mounted detaching rollers rotatable about substantially horizontal axes spaced from one another in a travelling direction and extending transversely thereto; each detaching roller having a plurality of detaching elements in a plurality of side-by-side situated circumferential series; the two detaching rollers being supported for simultaneous penetration into a top bale surface during a fiber detaching operation; and a grate formed of a plurality of spaced grate bars extending parallel to said travelling direction; the detaching elements of each said circumferential series projecting into spaces between respective adjoining said grate bars;

the improvement comprising roller setting means for adjusting a height level of said detaching rollers relative to one another for effecting simultaneous penetration of said detaching rollers into the top bale surface to different depths thereof during the detaching operation; said roller setting means being operatively connected to at least one of said detaching rollers for setting the height level thereof relative to another of said detaching rollers; said roller setting means including (a) a rocker tiltable about a horizontal axis oriented transversely to said travelling direction; said detaching rollers being mounted on said rocker;

(b) power means connected to said rocker for pivoting said rocker about said horizontal axis; and (c) control means for actuating said power means.

2. A detaching device as defined in claim 1, further comprising grate holding means for supporting said grate at a constant high level.

3. In a travelling fiber tuft detaching device for removing fiber tufts from top surfaces of stationarily support fiber bales, including two parallel-mounted detaching rollers rotatable about substantially horizontal axes spaced from one another in a travelling direction and extending transversely thereto; each detaching roller having a plurality of detaching elements in a plurality of side-by-side situated circumferential series; the two detaching rollers being supported for simultaneous penetration into a top bale surface during a fiber detaching operation; and a grate formed of a plurality of spaced grate bars extending parallel to said travelling direction; the detaching elements of each said circumferential series projecting into spaces between respective adjoining said grate bars;

the improvement comprising (a) roller setting means for adjusting a height level of said detaching rollers relative to one another for effecting simultaneous penetration of said detaching rollers into the top bale surface to different depths thereof during the detaching operation; and (b) control means including (1) measuring means for generating measuring signals representing the energy consumption of the detaching rollers;

(2) comparator means for comparing the measuring signals for determining the difference between the energy consumption of said detaching rollers; and (3) a control device connected to said comparator means for receiving comparison signals from said comparator means; said control device being connected to said roller setting means for actuating said roller setting means as a function of the difference between the energy consumption of the detaching rollers.

4. A detaching device as defined in claim 3, wherein said measuring means includes tachometers connected to respective said detaching rollers.

5. A detaching device as defined in claim 3, further comprising electric motor means; said measuring means being connected to said electric motor means for measuring the electric current consumption thereof.

6. A detaching device as defined in claim 5, wherein said measuring means includes incremental rotation indicators having a slotted disc affixed to a respective said detaching roller and a stationary sensor means arranged adjacent said slotted disc for generating signals representing the rpm of said slotted disc.

7. In a travelling fiber tuft detaching device for removing fiber tufts from top surfaces of stationarily support fiber bales, including two parallel-mounted detaching rollers rotatable about substantially horizontal axes spaced from one another in a travelling direction and extending transversely thereto; each detaching roller having a plurality of detaching elements in a plurality of side-by-side situated circumferential series; the two detaching rollers being supported for simultaneous penetration into a top bale surface during a fiber detaching operation; and a separate grate cooperating with each said detaching roller; each said grate being formed of a plurality of spaced grate bars extending parallel to said travelling direction; the detaching elements of each said circumferential series projecting into spaces between respective adjoining said grate bars; said grates having open ends oriented toward one another;

the improvement comprising (a) grate setting means for adjusting a vertical height level of said grates relative to one another for effecting simultaneous penetration of said detaching rollers into the top bale surface to different depths thereof during the detaching operation; and (b) control means including (1) measuring means for generating measuring signals representing the energy consumption of the detaching rollers;

(2) comparator means for comparing the measuring signals for determining the difference between the energy consumption of said detaching rollers; and (3) a control device connected to said comparator means for receiving comparison signals from said comparator means; said control device being connected to said grate setting means for actuating said grate setting means as a function of the difference between the energy consumption of the detaching rollers.

8. A detaching device as defined in claim 7, wherein said detaching rollers are at a same fixed height level.

9. In a travelling fiber tuft detaching device for removing fiber tufts from top surfaces of stationarily supported fiber bales, including two parallel-mounted detaching rollers rotatable about substantially horizontal axes spaced from one another in a travelling direction and extending transversely thereto; each detaching roller having a plurality of detaching elements in a plurality of side-by-side situated circumferential series; the two detaching rollers being supported for simultaneous penetration into a top bale surface during a fiber detaching operation; and a separate grate cooperating with each said detaching roller; each said grate being formed of a plurality of spaced grate bars extending parallel to said travelling direction; the detaching elements of each said circumferential series projecting into spaces between respective adjoining said grate bars; said grates having open ends oriented toward one another;

the improvement comprising grate setting means for adjusting a vertical height level of said grates relative to one another for effecting simultaneous penetration of said detaching rollers into the top bale surface to different depths thereof during the detaching operation; and roller setting means for adjusting a vertical height level of said detaching rollers relative to one another; said grate setting means and said roller setting means including (a) a detacher housing supporting said grates and said detaching rollers;

(b) means for pivotally supporting said detacher housing for pivotal motion about a horizontal axis; and (c) actuating means connected to said detacher housing for effecting pivotal motion thereof.

10. A detaching device as defined in claim 9, further comprising bale pressing rollers supported by said detacher housing and arranged parallel to and in a flanking relationship with said detacher rollers.

11. In a travelling fiber tuft detaching device for removing fiber tufts from top surfaces of stationarily supported fiber bales, including two parallel-mounted detaching rollers rotatable about substantially horizontal axes spaced from one another in a travelling direction and extending transversely thereto; each detaching roller having a plurality of detaching elements in a plurality of side-by-side situated circumferential series; the two detaching rollers being supported for simultaneous penetration into a top bale surface during a fiber detaching operation; and a separate grate cooperating with each said detaching roller; each said grate being formed of a plurality of spaced grate bars extending parallel to said travelling direction; the detaching elements of each said circumferential series projecting into spaces between respective adjoining said grate bars; said grates having open ends oriented toward one another;

the improvement comprising (a) grate setting means for adjusting a vertical height level of said grates relative to one another for effecting simultaneous penetration of said detaching rollers into the top bale surface to different depths thereof during the detaching operation; said grate setting means comprising separate grate setting devices operatively connected to respective said grates for setting the height level thereof independently from one another; and (b) roller setting means for adjusting a vertical height level of said detaching rollers relative to one another; said roller setting means comprising separate roller setting devices operatively connected to respective said detaching rollers for setting the height level thereof independently from one another.

12. A detaching device as defined in claim 11, further comprising pressing rollers arranged parallel to and in a flanking relationship with said detacher rollers; and pressing roller setting devices operatively connected to respective said pressing rollers for setting the height level thereof independently from one another.

13. In a travelling fiber tuft detaching device for removing fiber tufts from top surfaces of stationarily supported fiber bales, including two parallel-mounted detaching rollers rotatable about substantially horizontal axes spaced from one another in a travelling direction and extending transversely thereto; each detaching roller having a plurality of detaching elements in a plurality of side-by-side situated circumferential series; the two detaching rollers being supported for simultaneous penetration into a top bale surface during a fiber detaching operation; and a separate grate cooperating with each said detaching roller; each said grate being formed of a plurality of spaced grate bars extending parallel to said travelling direction; the detaching elements of each said circumferential series projecting into spaces between respective adjoining said grate bars; said grates having open ends oriented toward one another;

the improvement comprising a detacher housing; grate setting means for adjusting a vertical height level of said grates relative to one another for effecting simultaneous penetration of said detaching rollers into the top bale surface to different depths thereof during the detaching operation; and roller setting means for adjusting a vertical height level of said detaching rollers relative to one another; said grate setting means and said roller setting means including (a) a rocker frame carrying said grates and said detaching rollers;

(b) means for pivotally supporting said rocker frame in said detacher housing for pivotal motion about a horizontal axis; and (c) actuating means connected to said rocker frame for effecting a pivotal motion thereof.

14. A detaching device as defined in claim 13, further comprising bale pressing rollers carried by said rocker frame and arranged parallel to and in a flanking relationship with said detacher rollers.

15. In a method of operating a travelling fiber tuft detaching device for removing fiber tufts from top surfaces of stationarily support fiber bales, the detaching device including two parallel-mounted detaching rollers rotatable about substantially horizontal axes spaced from one another in a travelling direction and extending transversely thereto; each detaching roller having a plurality of detaching elements in a plurality of side-by-side situated circumferential series; and a grate formed of a plurality of spaced grate bars extending parallel to said travelling direction; the detaching elements of each said circumferential series projecting into spaces between respective adjoining said grate bars; the improvement comprising the following steps:

(a) simultaneously rotating the detaching rollers in directions oriented toward one another in a detaching zone;

(b) propelling the detaching device in a substantially horizontal direction to execute a forward and return fiber detaching passes; and (c) causing said detaching rollers to simultaneously penetrate to different depths into the bale surface during each fiber detaching pass; said step of causing said detaching rollers to penetrate to different depths including the step of effecting a deeper penetration of the leading detaching roller than the trailing detaching roller, as viewed in the travelling direction.

16. A method as defined in claim 15, further comprising the step of gradually changing the extent of penetration of said detaching roller during the course of the detaching passes.

17. A method as defined in claim 15, wherein the step of causing said detaching rollers to penetrate to different depths includes the step of maintaining the detaching rollers at different height levels.

18. A method as defined in claim 17, further comprising the step of switching the height level of the detaching rollers at the beginning of each forward and return pass.

* * * * *